US005680970A

United States Patent [19]

Smith et al.

[11] Patent Number: 5,680,970

[45] Date of Patent: Oct. 28, 1997

[54] SELF CLOSING DISPENSING VALVE BIASED BY RESILIENT FINGERS

[75] Inventors: Mark A. Smith, Westerville; M. Stephen Tschanen, Columbus, both of Ohio

[73] Assignee: Liqui-Box Corporation, Worthington, Ohio

[21] Appl. No.: 650,346

[22] Filed: May 20, 1996

Related U.S. Application Data

[63] Continuation of Ser. No. 528,155, Sep. 14, 1995, abandoned, which is a continuation of Ser. No. 376,523, Jan. 23, 1995, abandoned, which is a continuation of Ser. No. 197,755, Feb. 17, 1994, abandoned.

[51] Int. Cl.[6] ..... B67D 3/00

[52] U.S. Cl. ..... 222/514; 222/509; 222/518; 222/559

[58] Field of Search ..... 222/509, 514, 222/518, 105, 185.1, 559; 251/320, 337

[56] References Cited

U.S. PATENT DOCUMENTS

| | | | |
|---|---|---|---|
| Re. 22,837 | 1/1947 | Sanchis . | |
| 580,602 | 4/1897 | Jacobs . | |
| 1,122,624 | 12/1914 | McNutt . | |
| 1,540,082 | 6/1925 | Merrill . | |
| 1,676,034 | 7/1928 | Langdon . | |
| 1,731,250 | 10/1929 | McAtree . | |
| 1,791,350 | 2/1931 | Caron . | |
| 2,529,554 | 11/1950 | Katzmann . | |
| 2,714,475 | 8/1955 | Roehrich . | |
| 2,874,996 | 2/1959 | Zajac . | |
| 3,187,965 | 6/1965 | Bourget | 222/518 |
| 3,315,850 | 4/1967 | Gran . | |
| 3,355,143 | 11/1967 | Mueller . | |
| 3,378,330 | 4/1968 | Schwartzman . | |
| 3,433,456 | 3/1969 | Mueller . | |
| 3,601,287 | 8/1971 | Schwartzman . | |
| 3,658,216 | 4/1972 | Schwartzman . | |
| 3,999,570 | 12/1976 | Clements . | |
| 4,216,885 | 8/1980 | Sedam . | |
| 4,281,779 | 8/1981 | Shepard . | |
| 4,286,636 | 9/1981 | Credle . | |
| 4,306,667 | 12/1981 | Sedam . | |
| 4,310,025 | 1/1982 | Tracy . | |
| 4,319,441 | 3/1982 | Credle . | |
| 4,355,653 | 10/1982 | Credle . | |
| 4,359,432 | 11/1982 | Sedam . | |
| 4,376,496 | 3/1983 | Sedam . | |
| 4,421,297 | 12/1983 | Pongrass . | |
| 4,445,539 | 5/1984 | Credle . | |
| 4,449,545 | 5/1984 | Vernor . | |
| 4,458,719 | 7/1984 | Strybel . | |
| 4,462,510 | 7/1984 | Steer . | |
| 4,477,001 | 10/1984 | Galia | 222/509 X |
| 4,477,002 | 10/1984 | Stull . | |
| 4,541,552 | 9/1985 | Scheithauer . | |
| 4,570,826 | 2/1986 | Fattori | 222/518 X |
| 4,619,377 | 10/1986 | Roos . | |
| 4,655,374 | 4/1987 | Guerette . | |
| 4,687,123 | 8/1987 | Hyde . | |
| 4,693,400 | 9/1987 | Frahm . | |
| 4,700,744 | 10/1987 | Rutter . | |

(List continued on next page.)

FOREIGN PATENT DOCUMENTS

WO 9015951 12/1990 WIPO .

*Primary Examiner*—Gregory L. Huson
*Attorney, Agent, or Firm*—Vorys, Sater, Seymour & Pease

[57] ABSTRACT

A self-closing dispensing valve comprises a valve housing having a fluid conduit with a valve orifice therethrough, a flow control member within the valve body which is displaceable along an axis from a first position in which the flow control member obstructs the flow of fluid through the valve orifice to a second position in which the flow control member does not obstruct the flow of fluid through the valve orifice, and one or more resilient flexible fingers fixed to either the valve housing or the valve member which is deflected when the valve member is displaced to its open position. Preferably the fingers are arranged in pairs oriented parallel to the axis and are deflected toward the axis by a conical camming surface on the valve member when it is displaced from its closed position.

34 Claims, 19 Drawing Sheets

U.S. PATENT DOCUMENTS 4,815,861 3/1989 Heppenstiel .
4,821,925 4/1989 Wiley .
4,848,600 7/1989 Dark ..... 222/518 X
4,862,918 9/1989 Schroeder .
4,917,356 4/1990 Shirdavani .
4,930,689 6/1990 Stumpf .
4,934,655 6/1990 Blenkush .
4,942,976 7/1990 Spencer .
4,962,872 10/1990 Strong .
4,997,108 3/1991 Hata .
5,037,015 8/1991 Collins .
5,046,645 9/1991 Hagan .
5,096,098 3/1992 Garcia ..... 222/518 X
5,114,051 5/1992 Simon ..... 222/514 X
5,131,570 7/1992 Sawyer .
5,154,212 10/1992 Weber .
5,163,922 11/1992 McElveen .

SELF CLOSING DISPENSING VALVE BIASED BY RESILIENT FINGERS

RELATIONSHIP TO OTHER APPLICATIONS

This application is a continuation of U.S. application Ser. No. 08/528,155, filed Sep. 14, 1995, abandoned, which is a continuation of U.S. application Ser. No. 08/376,523 filed Jan. 23, 1995, abandoned, which is a continuation of U.S. application Ser. No. 08/197,755, filed Feb. 17, 1994, abandoned.

BACKGROUND OF THE INVENTION

1. Field of the Invention

This invention relates to dispensing valves for plastic bags and containers used for commercial distribution of liquid products and more particularly to such valves as are self-closing.

2. Brief Description of the Prior Art

Distribution and sale of liquid products in flexible plastic bags supported in corrugated cardboard boxes has enjoyed great commercial success. Such products as water, wine, syrups for reconstituting soft drinks and the like are shipped in these containers and dispensed directly from the containers at the point of use. In order to facilitate dispensing the liquid products, dispensing valves or taps are inserted into the plastic container to permit draining the contents by gravity. Such valves are made largely of plastic for reasons of economy and are discarded or recycled together with the liquid-containing bag. The valves are often made to be self-closing both for convenience and to prevent accidental spillage of the container contents from a tap that is not closed properly.

Self-closing valves for service in flexible bag distribution of liquids typically have valve housing through which the liquid flows from the bag to the outside, and a valve orifice within the valve housing which can be selectively obstructed by a valve member. A spring typically biases the valve member toward the closed position, and some means is provided for opening the valve by exerting a force on an external member to force the valve element away from its closed position to permit the liquid to flow out through the valve orifice.

Although many types of such dispensing valves have been used with flexible bags, the construction of these valves has presented some problems with respect to recycling the bag and valve. Ideally, the valve is made of the same plastic material as the bag, or one that is closely compatible therewith in order that the entire bag assembly can be simply recycled to further uses of the plastic. However, self-closing valves have typically used a spring member made of metal to bias the valve element toward the closed position. Evidently, the need to separate the spring introduces an extra step into the preparation of the bag for recycling thereby increasing the costs of recycling the bag. Furthermore, the use of a separate spring generally requires an specific assembly step which may increase the cost of the valve. Some dispensing valves have been made with plastic springs, but usually the plastic used for the spring is different from, and may be incompatible with, the plastic used for the bag and other valve parts. This again requires that the spring material be separated from the bag and valve before recycling, and may require a separate assembly step.

Accordingly, a need has continued to exist for a self-closing dispensing valve for plastic bag liquid containers that can be made from a single type of plastic or at least from types of plastic that are compatible with simple and total recycle of the bag and valve.

SUMMARY OF THE INVENTION

This problem has now been solved by the self-closing valve of this invention which comprises a valve housing having a fluid conduit therethrough, with a valve orifice in the conduit, a valve member within the valve housing displaceable along an axis from a first position in which the valve member obstructs the flow of fluid through the valve orifice and a second position in which the valve member does not obstruct the flow of fluid through the valve orifice, and biasing means for biasing the valve member toward the first position, the biasing means comprising a camming surface on either the valve member or the valve housing, at least one resiliently flexible finger having a base end and a tip end, the base end being fixed to the other of the valve member or the valve housing and extending generally parallel to said axis with the tip end of the finger being positioned to contact the camming surface and be displaced transversely to the axis when the valve member is displaced from its first position toward its second position.

The use of resilient flexible fingers to provide the biasing force to urge the valve member toward its closed position permits the entire valve structure to be made from one plastic material or at least from compatible plastic materials.

Accordingly, it is an object of the invention to provide a self-closing dispensing valve for use with flexible plastic bags used in commercial distribution of liquid products.

A further object is to provide a self-closing dispensing valve that is easily recyclable.

A further object is to provide a self-closing dispensing valve that can be made entirely from plastic.

A further object is to provide a self-closing dispensing valve that is simple to manufacture and assemble.

Other objects of the invention will become apparent from the description of the invention which follows.

DETAILED DESCRIPTION OF THE INVENTION AND PREFERRED EMBODIMENTS

Figure 1:
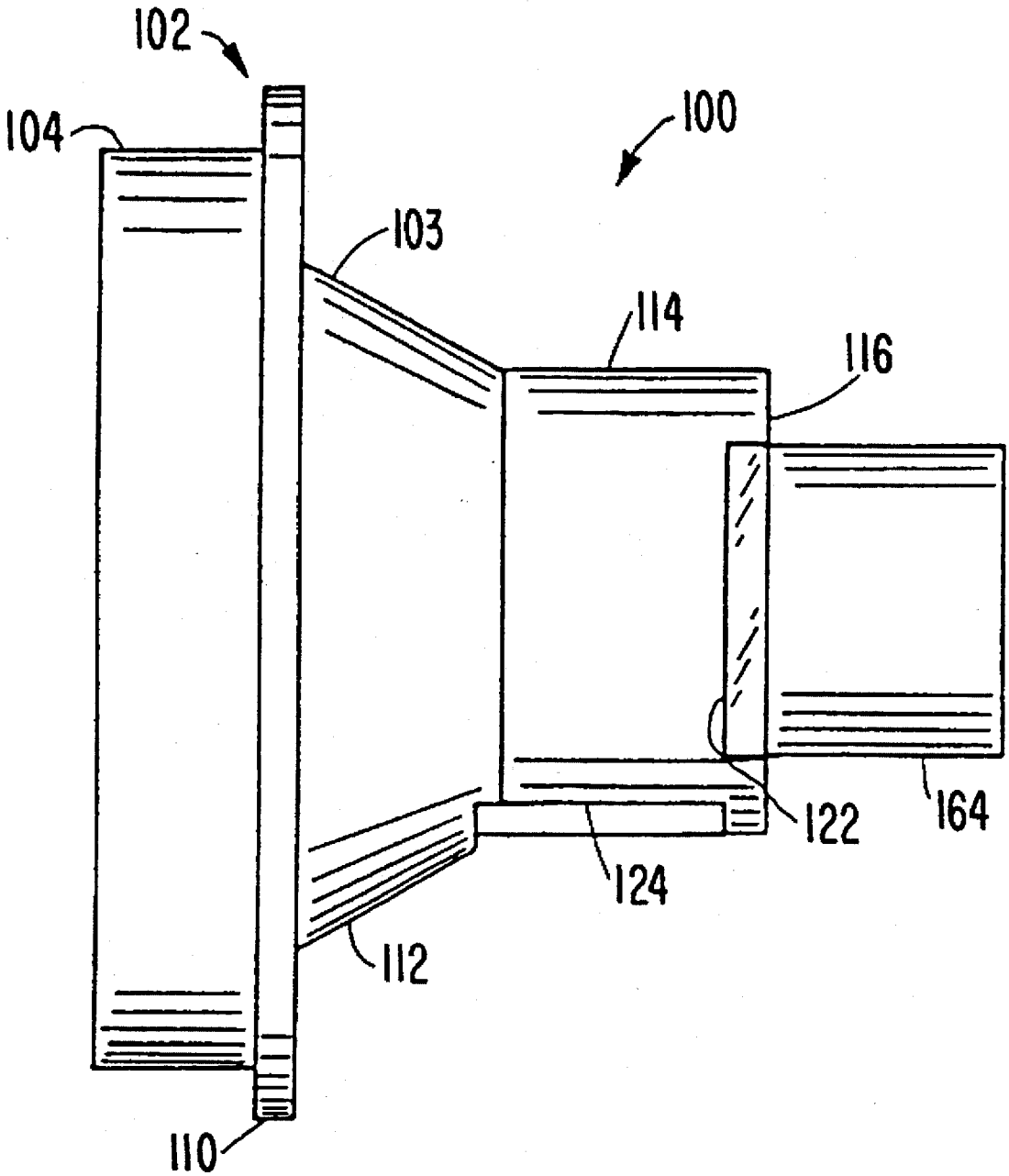
FIG. 1 is a side elevation view of a dispensing valve according to the invention.
Figure 2:
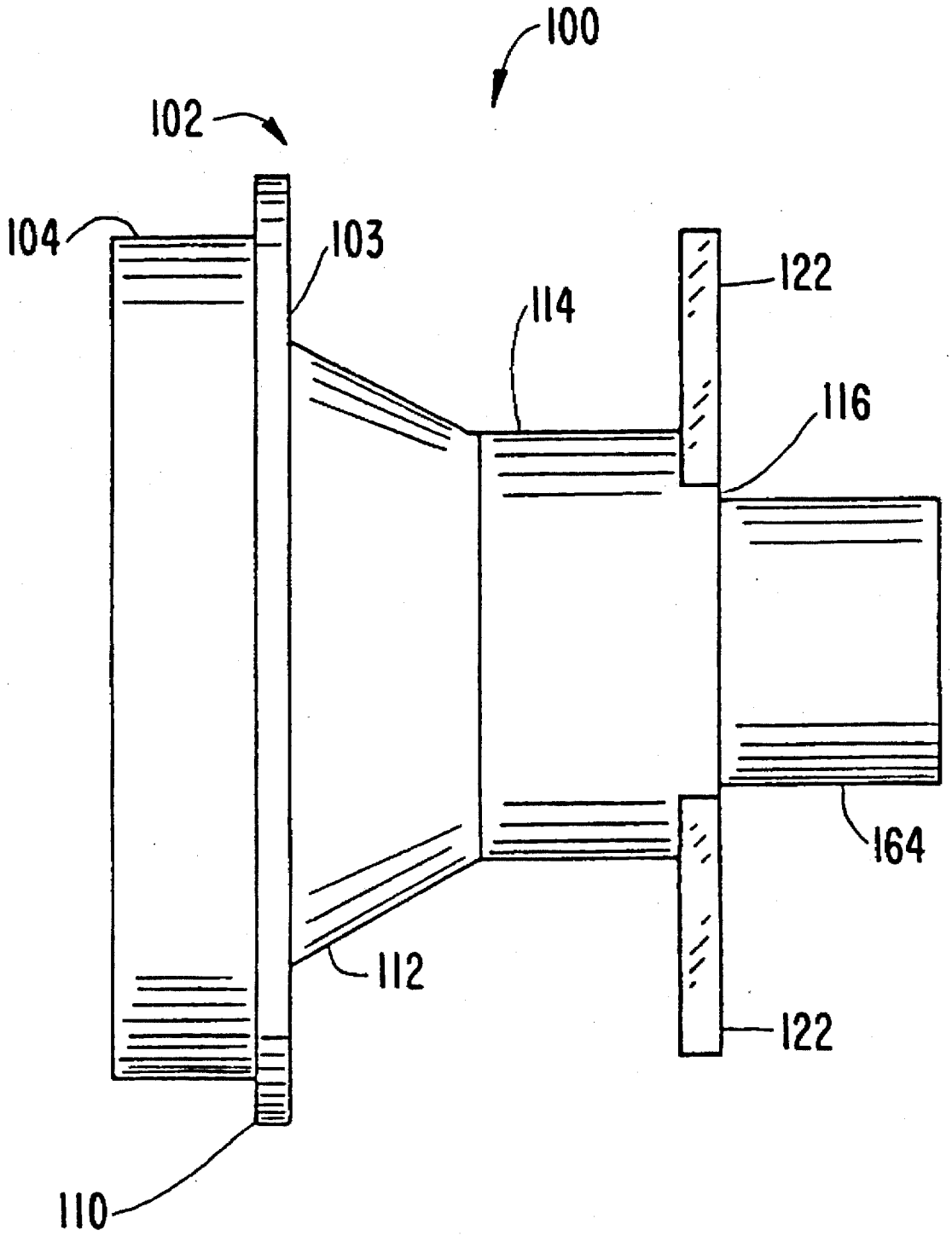
FIG. 2 is a top plan view of the dispensing valve of FIG. 1.
Figure 3:
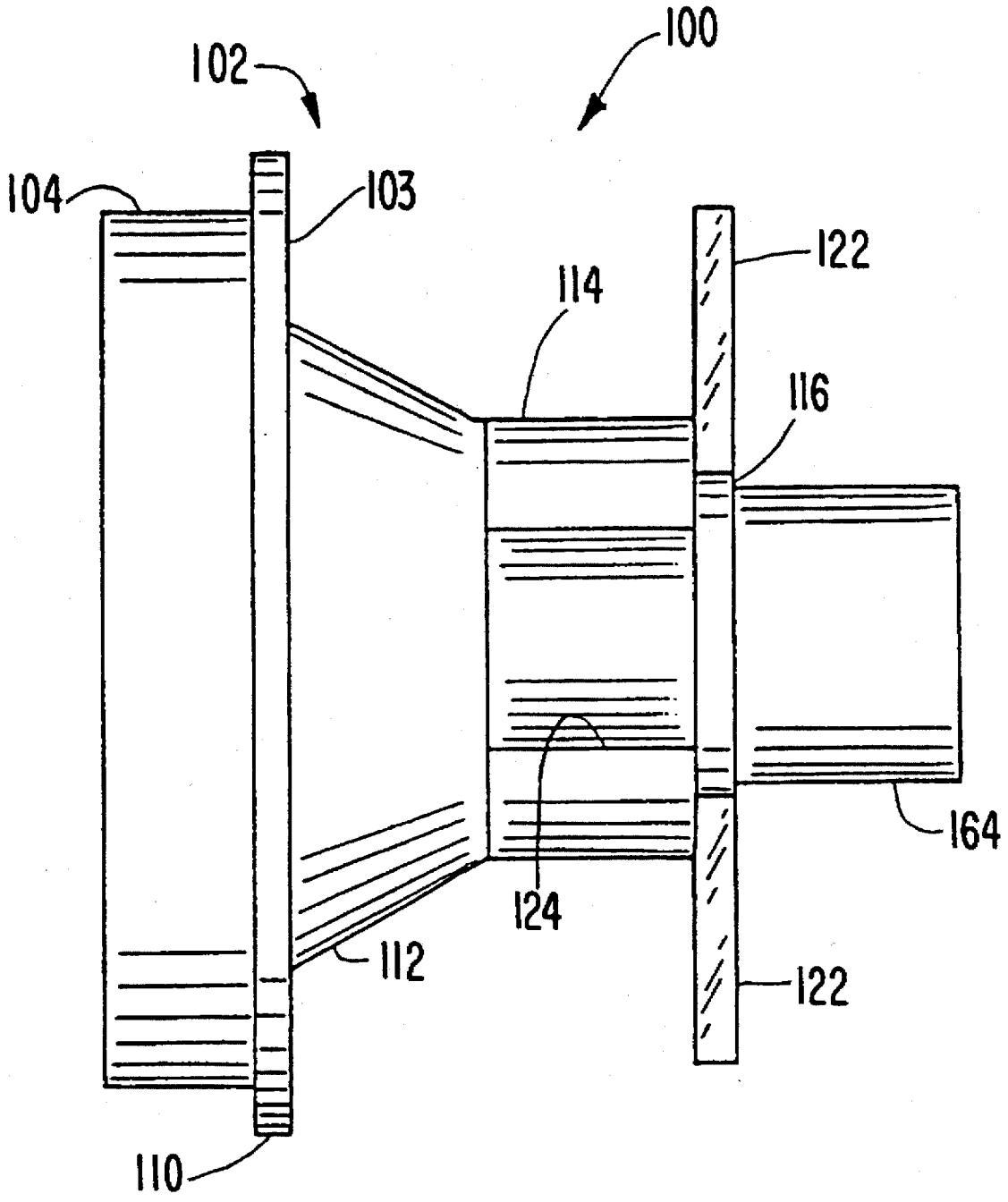
FIG. 3 is a bottom view of the dispensing valve of FIG. 1.
Figure 4:
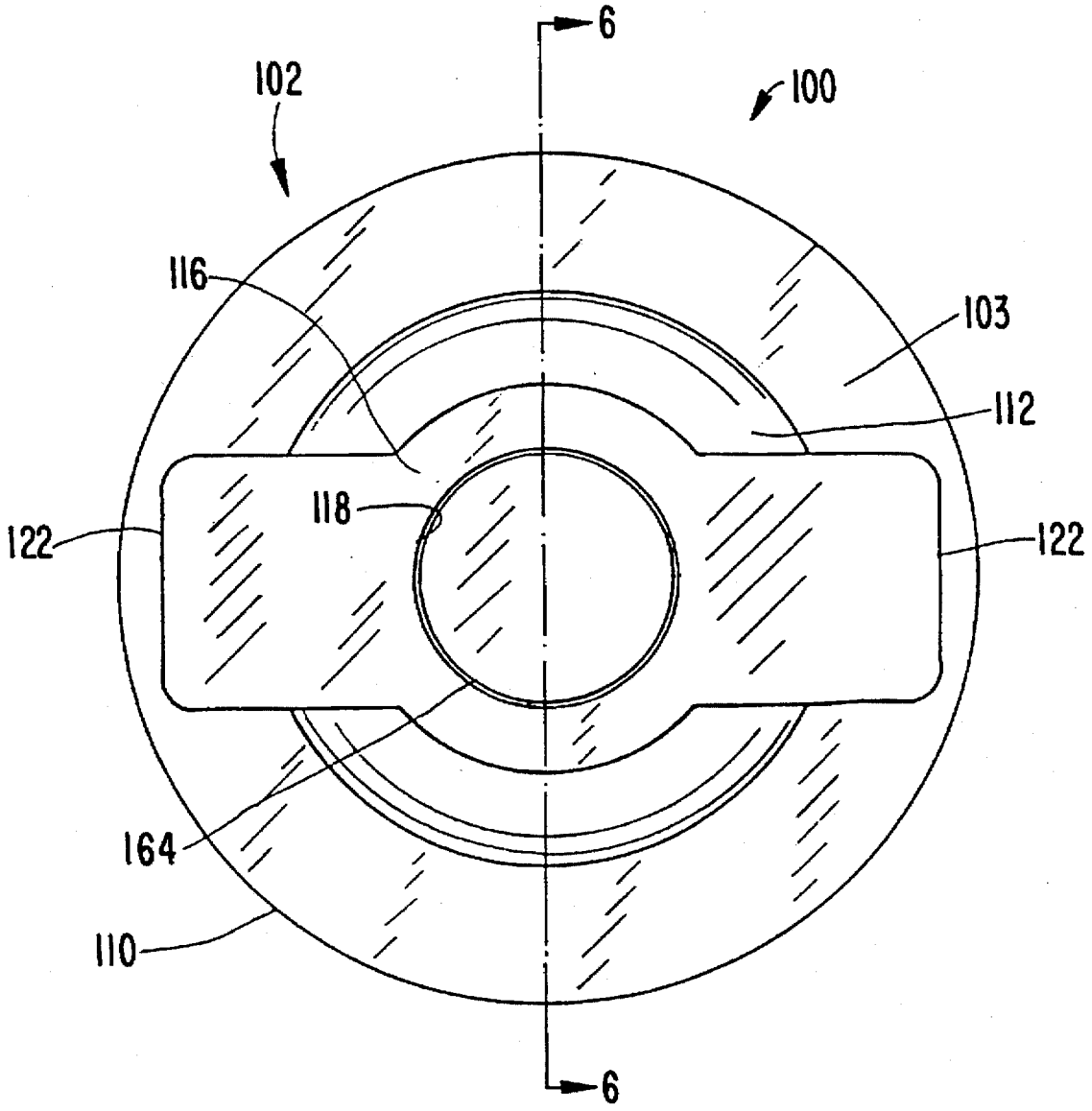
FIG. 4 is a front view of the dispensing valve of FIG. 1.
Figure 5:
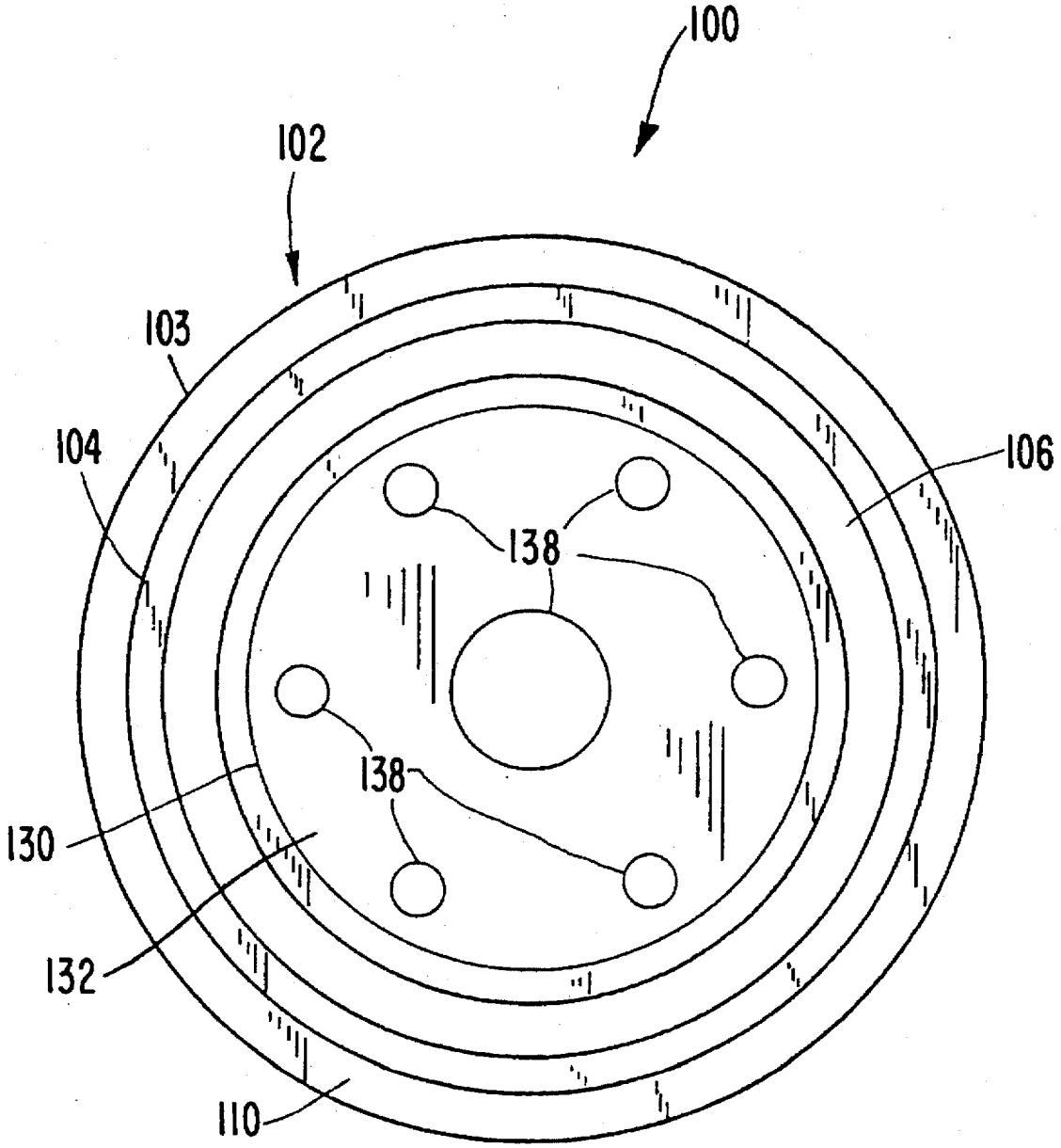
FIG. 5 is a rear view of the dispensing valve of FIG. 1.
Figure 6A:
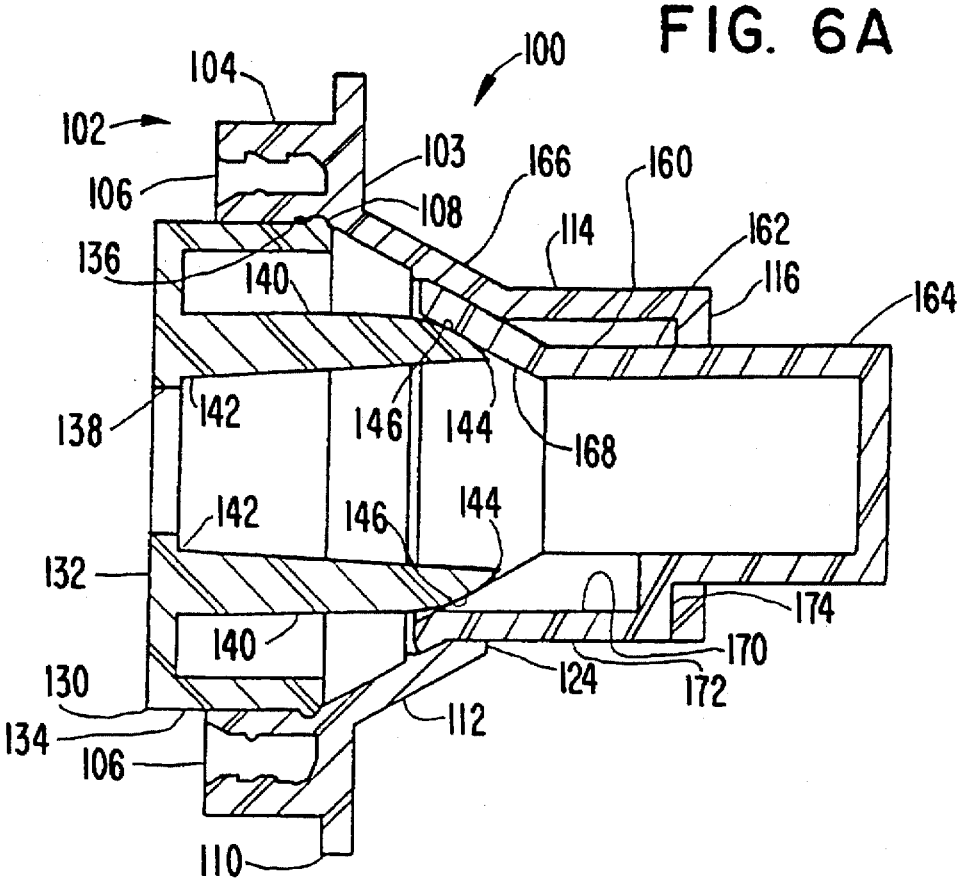
FIG. 6(A) is a vertical cross sectional view of the dispensing valve of FIGS. 1–5, taken along the line 6—6 in FIG. 4, showing the valve in its closed position.
Figure 6B:
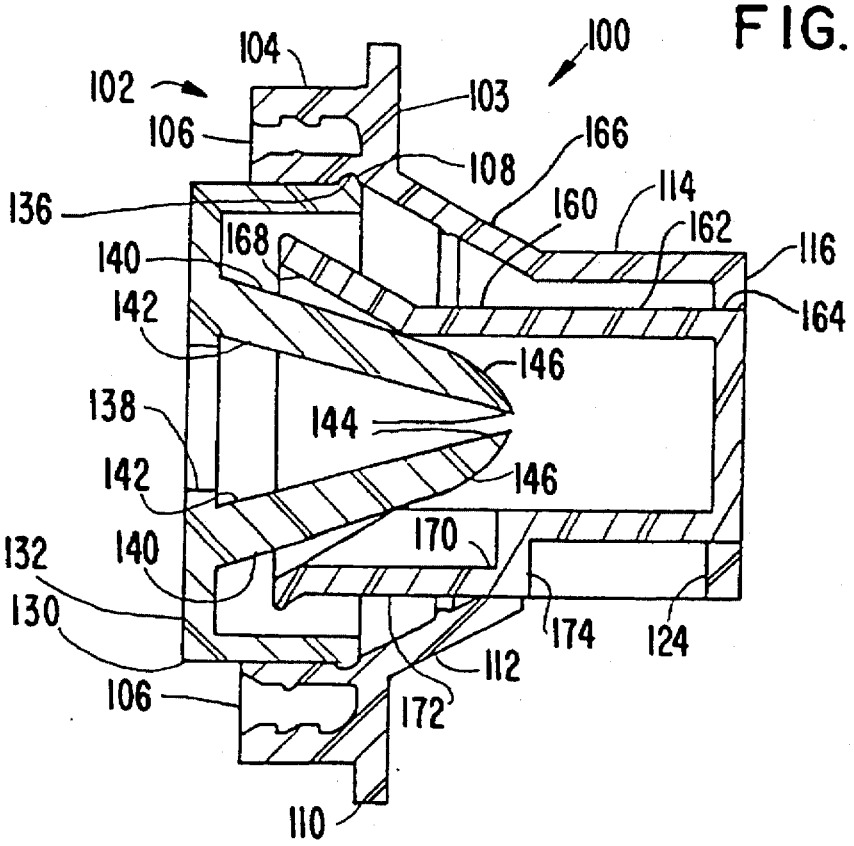
FIG. 6(B) is a vertical cross sectional view of the dispensing valve of FIGS. 1–5, taken along the line 6—6 in FIG. 4, showing the valve in its open position.
Figure 7:
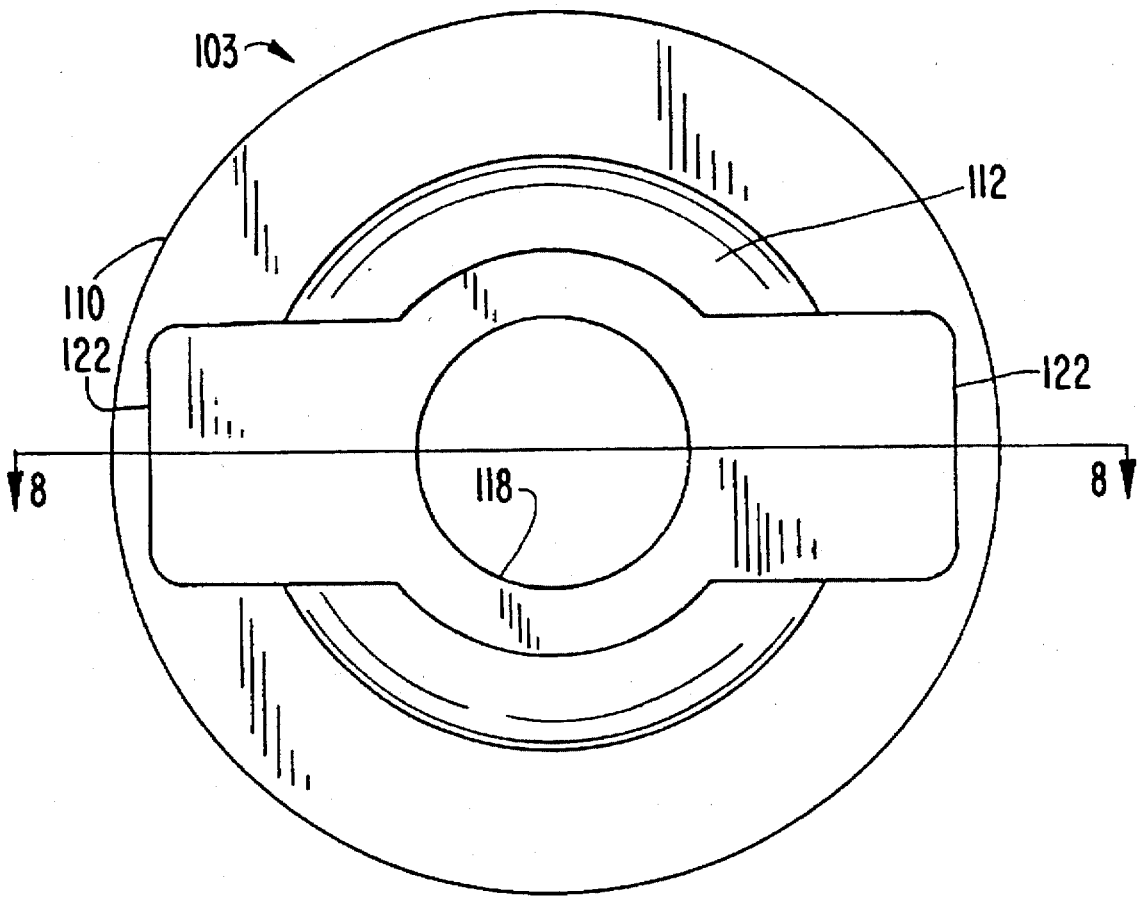
FIG. 7 is a front view of the valve body element of the dispensing valve of FIG. 1.

One embodiment of the dispensing valve of the invention is illustrated in FIGS. 1–13 wherein the parts of the valve are designated by the same reference numerals throughout.

Figure 8:
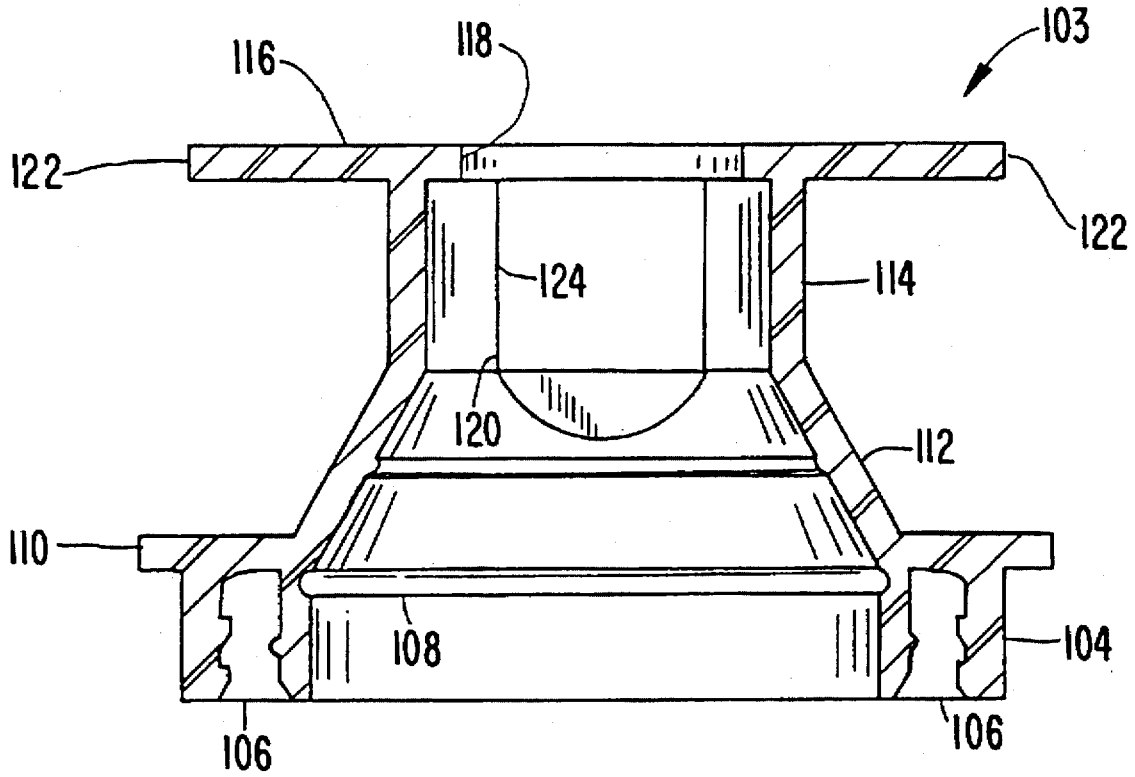
FIG. 8 is a plan cross sectional view of the valve body of FIG. 7 taken along the line 8—8.
Figure 9:
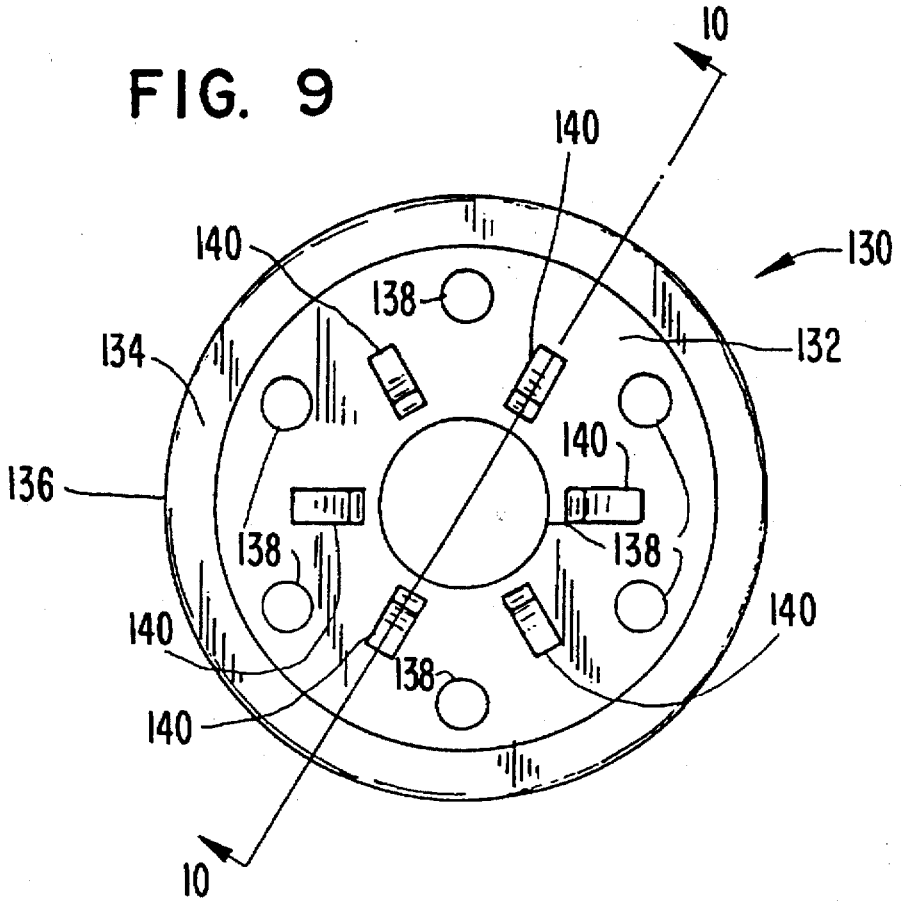
FIG. 9 is a front view of the valve body cap of the dispensing valve of FIG. 1.
Figure 10:
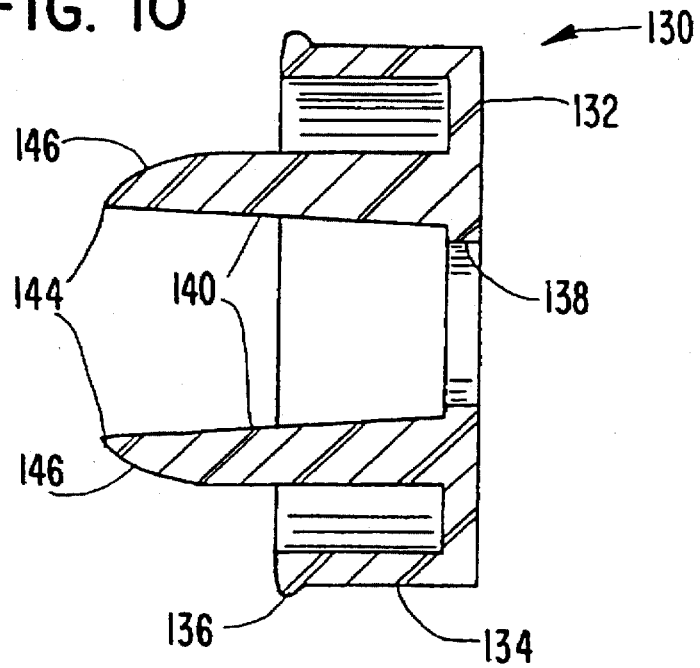
FIG. 10 is a cross sectional view of the valve body cap of FIG. 9 taken along the line 10—10.

The dispensing valve 100 of FIGS. 1–13 comprises a valve housing 102 having a valve body 103 bearing a rim 104 for attaching the valve to a liquid container such as a flexible bag (not shown). The valve may be attached to such a bag by means of the groove 106 which may mate with a corresponding fitting on the bag. A flange 110 surrounding the valve body 103 provides strength and may help to position the valve within a cardboard box surrounding the liquid-containing bag. The valve body 103 is formed from a frusto-conical section 112 and a generally cylindrical outlet section 114 extending from the narrow end of the frusto-conical section 112. The outlet section 114 terminates in a front wall 116 having a bearing hole 118 through which the actuating portion 164 of the valve member 160 protrudes, and which acts as a guide and bearing for the valve member 160. The front wall 116 is provided with laterally extending finger grips 122 to aid an operator in using the dispensing valve 100. The lower portion of the cylindrical outlet section 114 of the valve body 102 is cut away to form a generally rectangular outlet orifice 124. A guide channel 120 within the lower portion of the valve body 102 positions the valve member 160, as best seen in FIG. 8.

The rear of the valve housing 102 is formed by a cap 130. The cap 130 comprises a circular rear wall 132 having a rim 134 that fits into the rear of valve body 103. The rim 134 is provided with a circumferential lip 136 that mates with cap retaining groove 108 in the valve body 103 to fix the cap to the valve body 103. The rear wall 132 is provided with inlet holes 138 that permit liquid to flow from the bag into the valve housing 102. Resilient flexible fingers 140 are attached at their bases 142 to the rear wall 132 and they extend forward from the rear wall 132 generally parallel to the axis of the valve body 102. The tips 144 of the fingers 140 are located adjacent the camming surface 168 of the valve member 160. The fingers 140 are preferably integrally molded with the rear cap 130 and are formed of a synthetic resin material having an elastic modulus sufficiently high that the fingers are flexibly resilient but relatively stiff along the long dimension of the finger.

Figure 12:
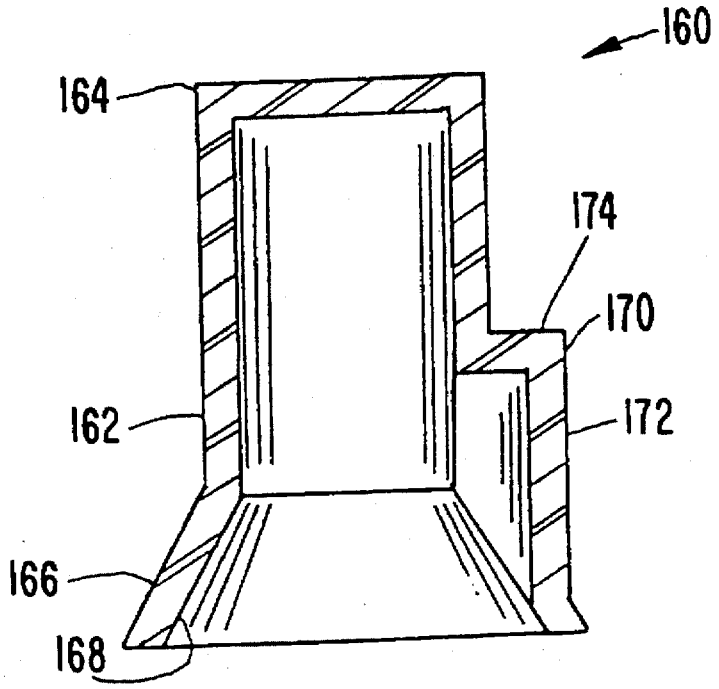
FIG. 12 is a side axial cross section view of the valve member of FIG. 11 taken along the line 12—12.
Figure 11:
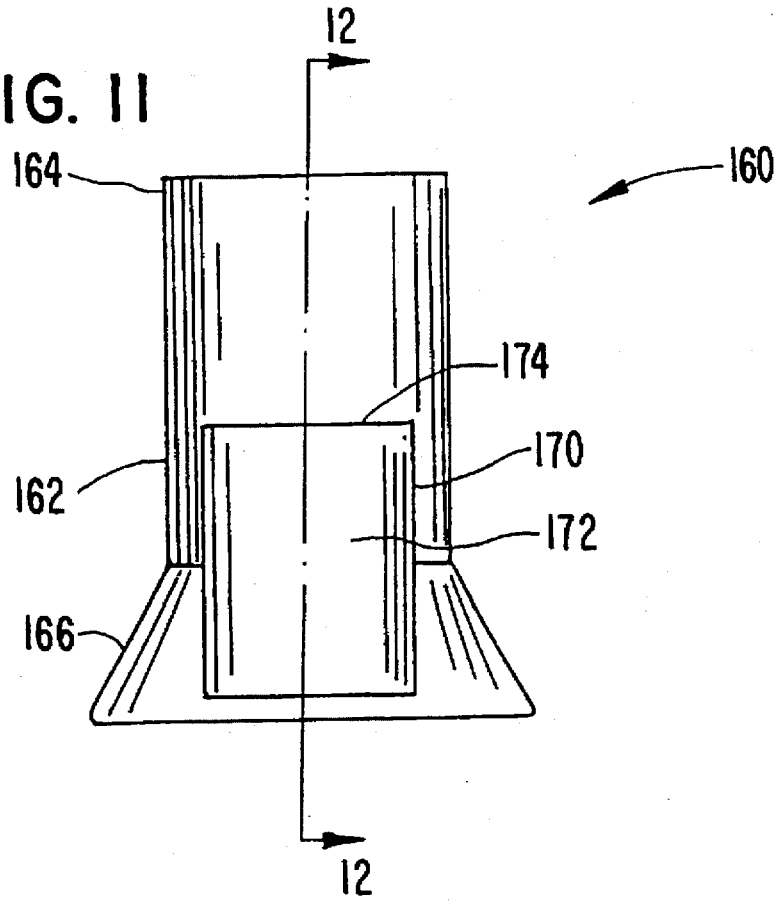
FIG. 11 is a bottom view of the valve member of the dispensing valve of FIG. 1.
Figure 13:
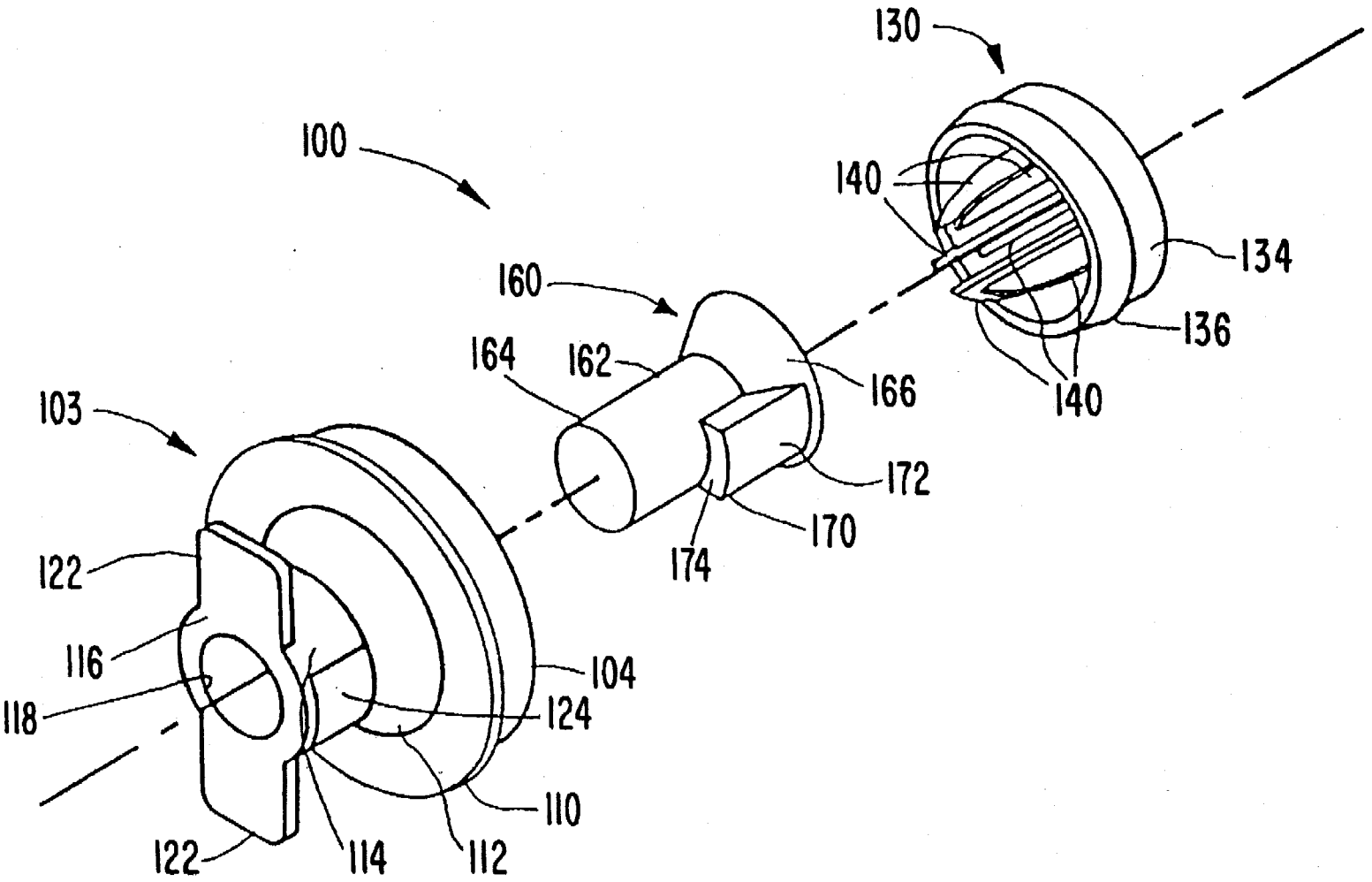
FIG. 13 is an isometric exploded assembly view of the dispensing valve of FIG. 1.

The valve member 160, shown in detail in FIGS. 11 and 12, has a cylindrical portion 162 and a conical rear portion 166. The forward part of the cylindrical portion 162 protrudes through the bearing hole 118 in the valve body 102 and serves to provide an actuation member for opening the valve 100. The conical portion 166 has on its interior surface a conical camming surface 168. This conical camming surface 168 engages the corresponding camming surfaces 146 on the radially outer portions of the fingers 140. As the valve member 160 is displaced from its closed position, shown in FIG. 6A, to its open position, shown in FIG. 6B, by rearward force applied to the actuating protrusion 164, the conical camming surface 168 on the valve member 160, acting on the camming surfaces 146 of the resilient fingers 140, forces the fingers 140 radially inward. When the pressure on the actuating protrusion 164 is released, the radially outward force exerted by the resilient fingers 140 on the camming surface 168 forces the valve member forward to the closed position.

The valve boss 170 on the bottom side of valve member 160 slides in guide channel 120 within the valve body 102. In the closed position (FIG. 6A) the valve boss obstructs the outlet orifice 124, thereby preventing liquid from flowing through the valve. In the open position (FIG. 6B) the valve boss 170 is retracted and the outlet orifice 124 is open, permitting liquid to flow from the bag through the inlet holes 138, through the space within the valve housing 102 and out the outlet orifice 124.

Although the valve 100 of this invention may be made of any material having suitable properties, it is preferred that the valve be made of a synthetic resin material that can be molded to form the parts of the valve 100. The synthetic resin material must have sufficient resiliency so that the fingers will return to their rest positions when the deforming pressure is released and thereby restore the valve member 160 to its closed position. If the valve 100 of the invention is made from a single synthetic resin material, recycling of the valve is made particularly easy, because the used valve can be ground up, remelted and remolded into new valves. It is preferred that the valve 100 be made from a synthetic resin that is that same as that used to form the liquid-containing bag with which the dispensing valve is used. Such compatibility further increases the ease of recycling the valve. A preferred synthetic resin for the valve is polypropylene. The valve can also be made of high-density polyethylene, polystyrene, nylon or the like. Similarly, the rear cap 130 can be made from a synthetic resin material that has properties suitable for forming resilient fingers, while the other components of the valve can be made from other suitable plastics.

Figure 14:
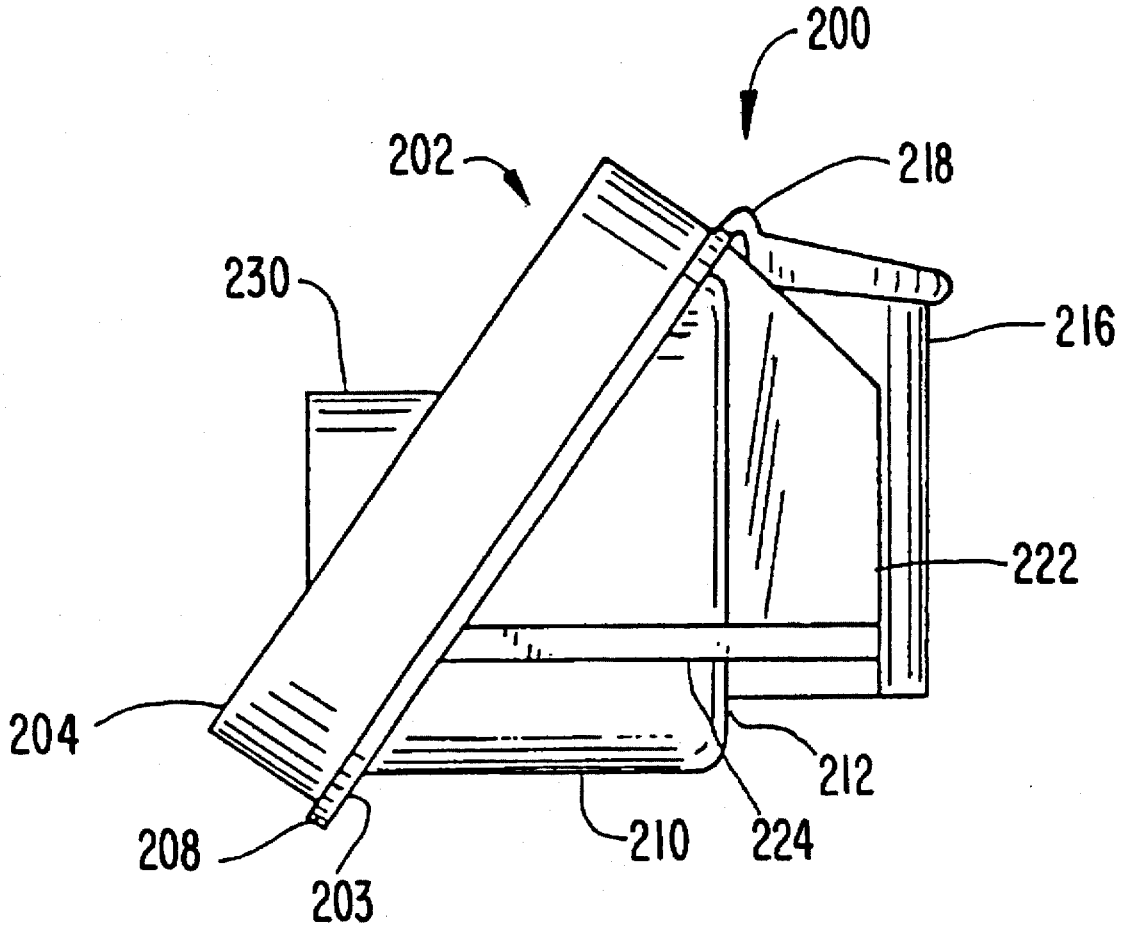
FIG. 14 is a side elevation view of another embodiment of the dispensing valve according to the invention.
Figure 15:
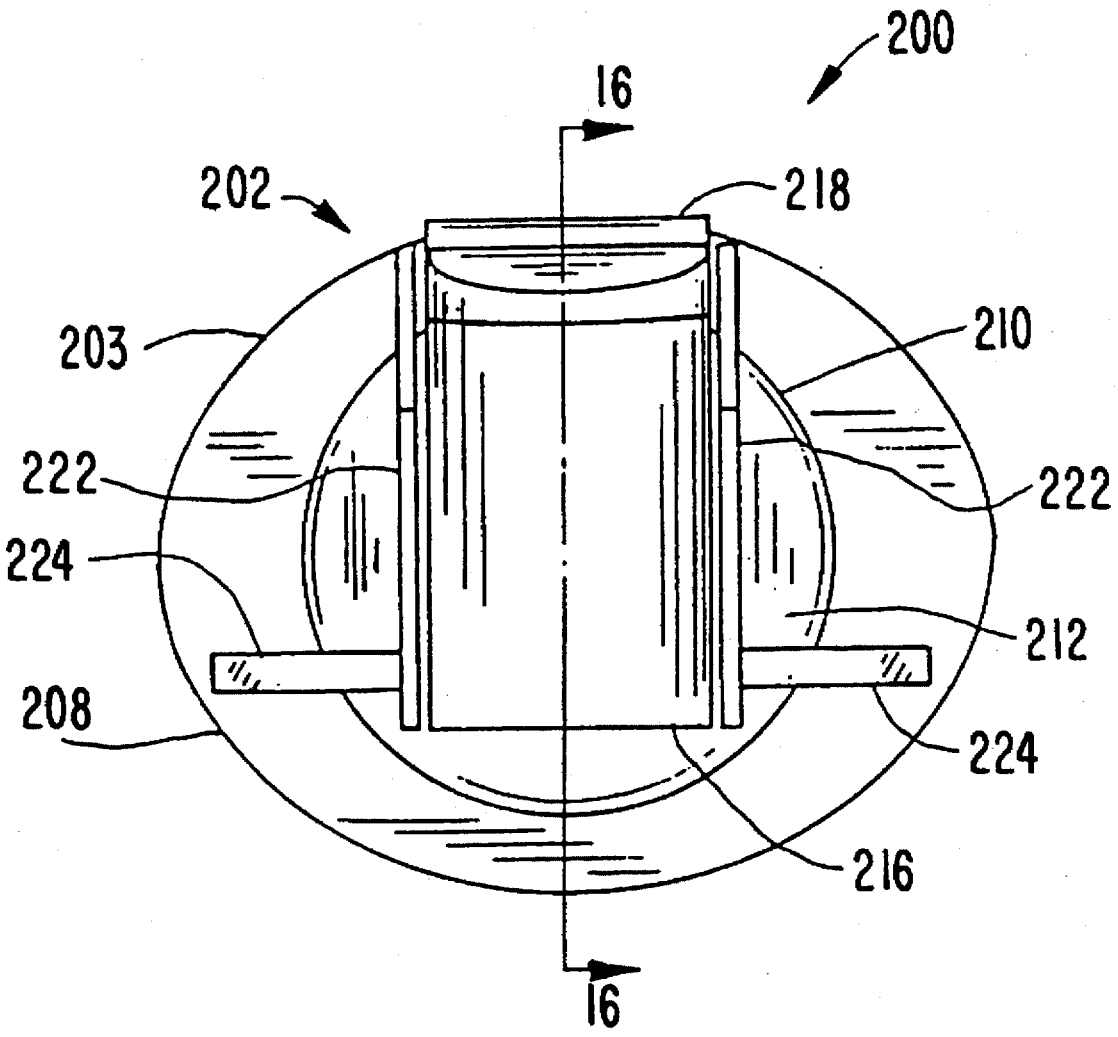
FIG. 15 is a front view of the dispensing valve of FIG. 14.
Figure 16:
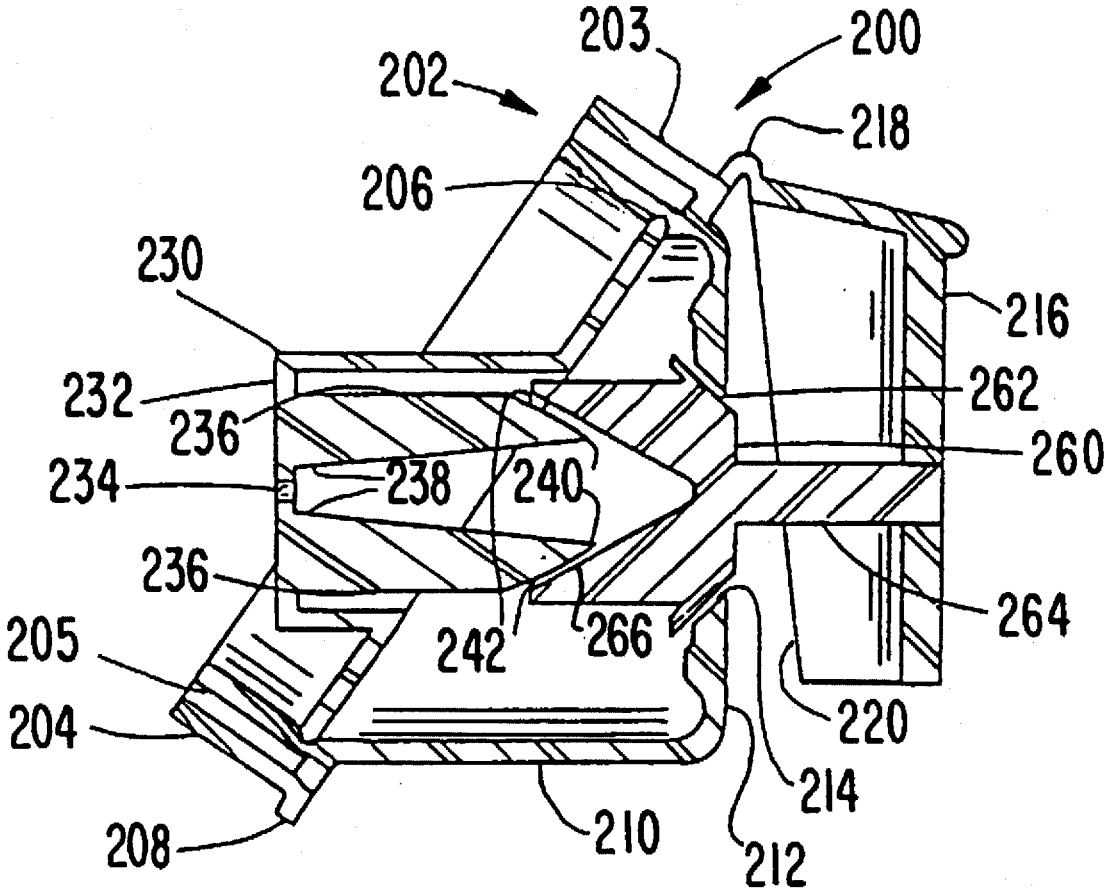
FIG. 16 is a vertical cross sectional view of the dispensing valve of FIGS. 14–15, taken along the line 16—16 in FIG. 15, showing the valve in its closed position.
Figure 17:
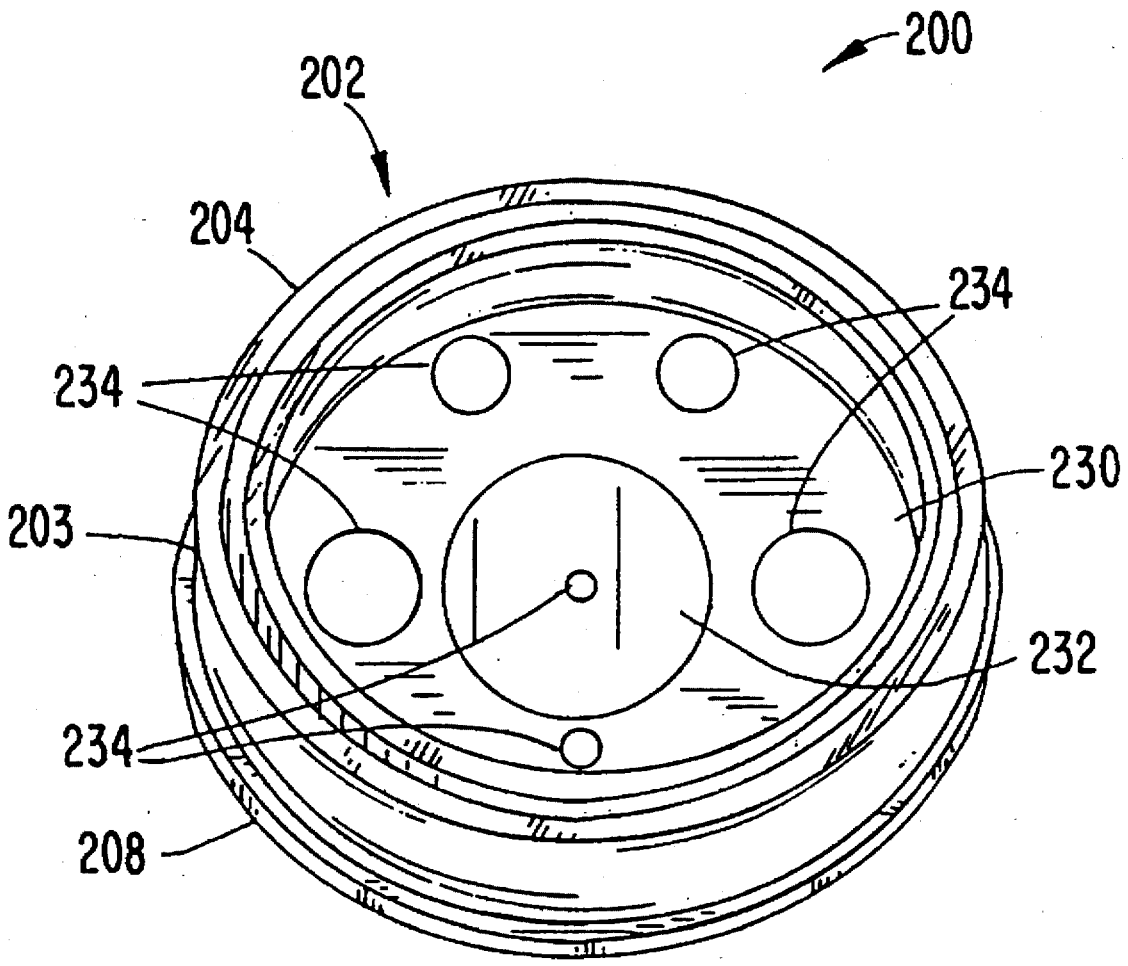
FIG. 17 is a rear view of the dispensing valve of FIG. 14.
Figure 18:
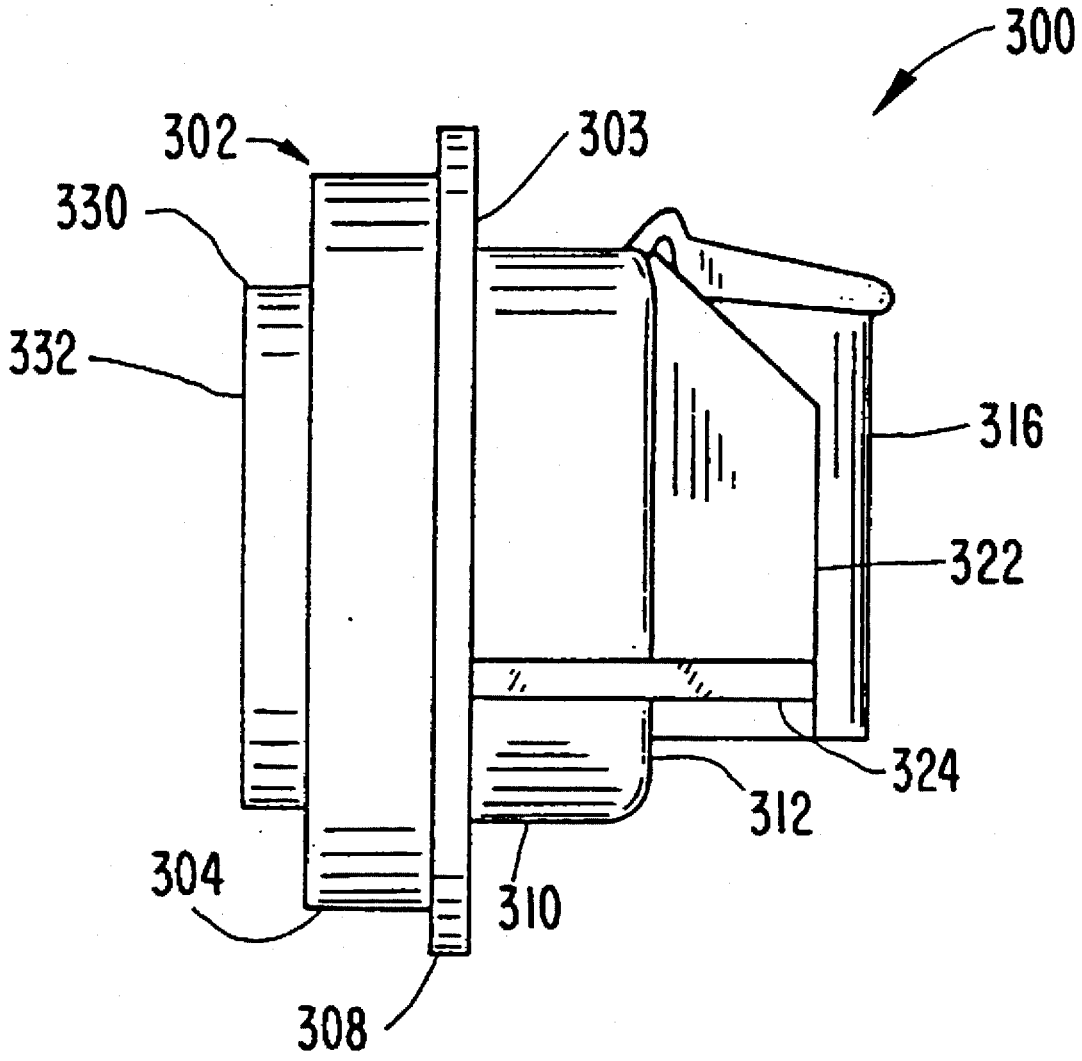
FIG. 18 is a side elevation view of another embodiment of the dispensing valve according to the invention.
Figure 19:
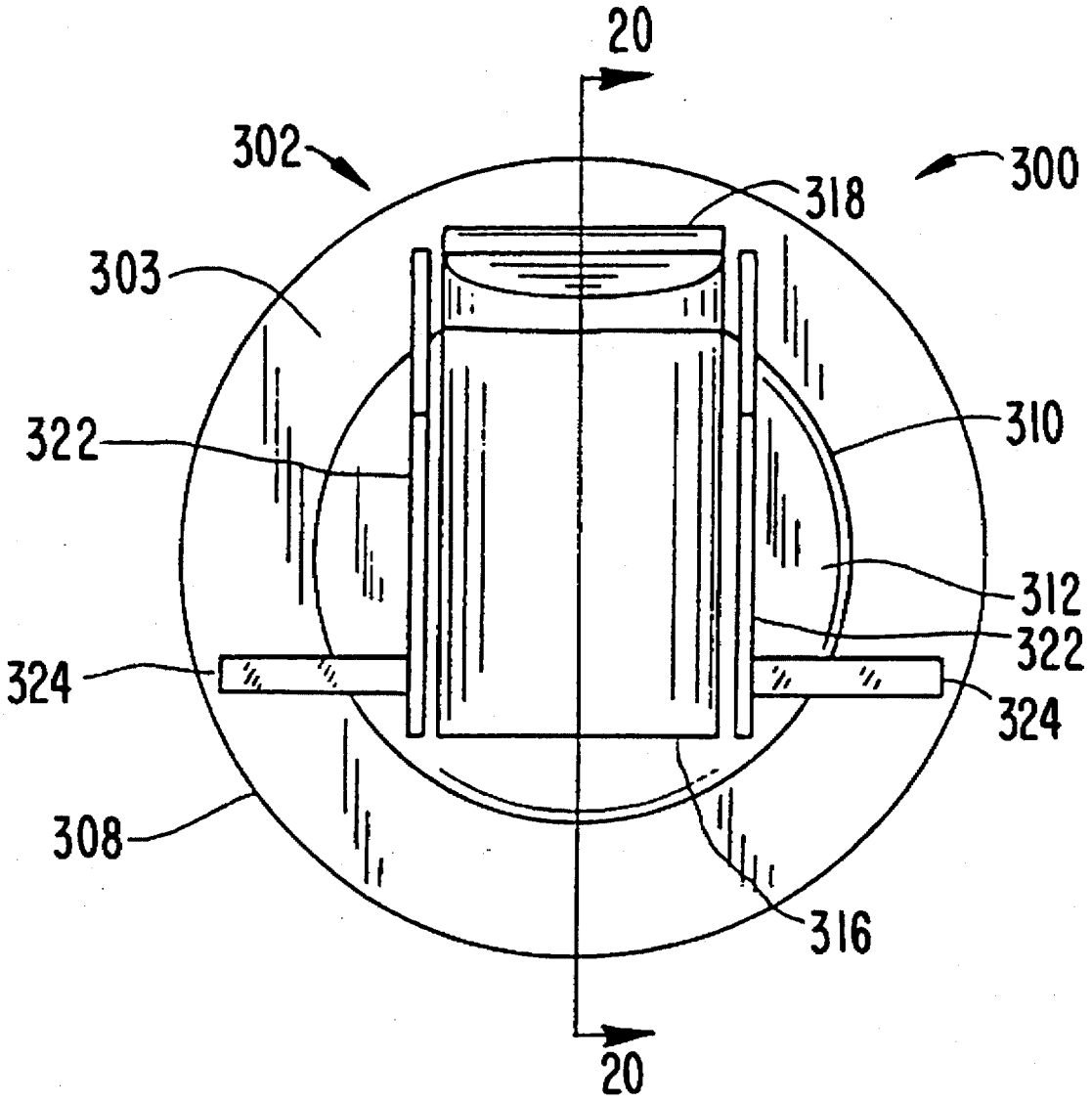
FIG. 19 is a front view of the dispensing valve of FIG. 18.
Figure 20:
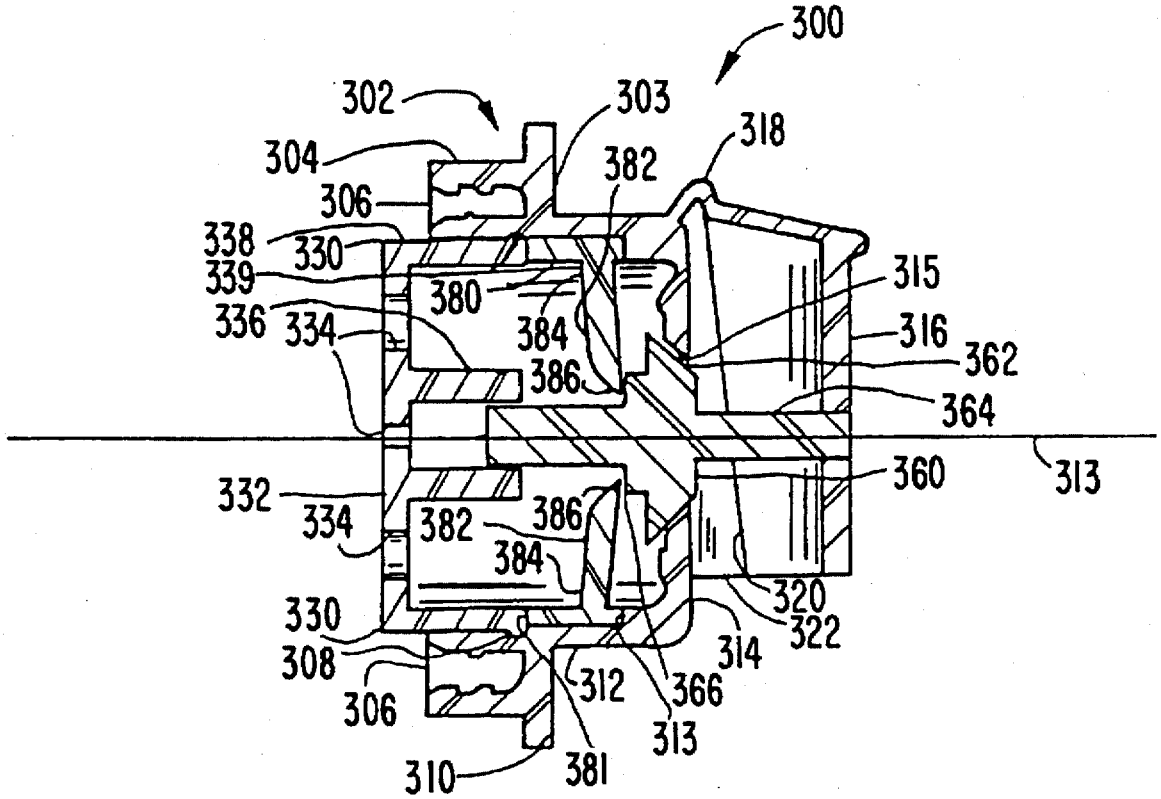
FIG. 20 is a vertical cross sectional view of the dispensing valve of FIGS. 18–19, taken along the line 20—20 in FIG. 19, showing the valve in its closed position.
Figure 21:
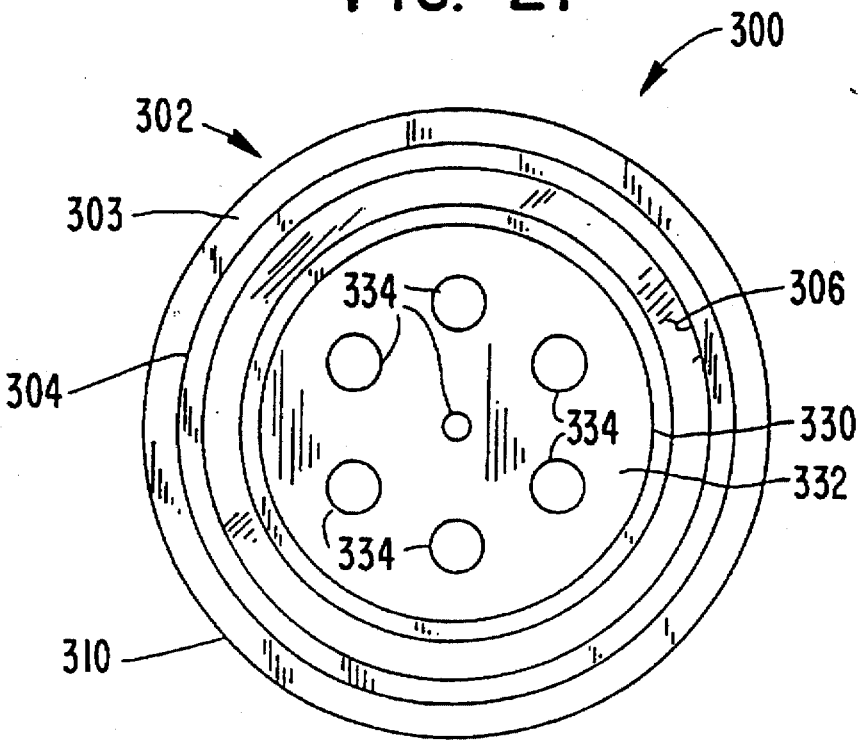
FIG. 21 is a rear view of the dispensing valve of FIG. 18.
Figure 22:
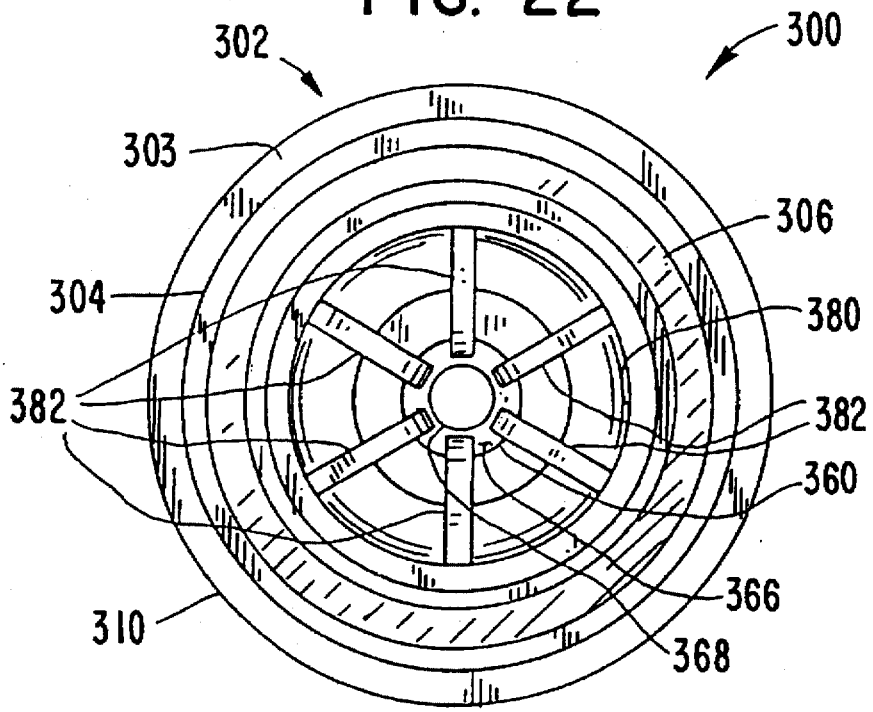
FIG. 22 is a rear view of the dispensing valve of FIG. 18 with the rear cap removed.

Another dispensing valve 200 of the invention is illustrated in FIGS. 14–17. Valve 200 comprises a valve housing 202 comprising a valve body 203 provided at its rear end with a rim 204 with groove 205 for engaging a flexible bag or other liquid container not shown. The rim is provided with a cap retaining groove 206 and is surrounded by a flange 208. In the embodiment of FIG. 14 the rim and flange are inclined in order to accommodate a liquid container having an outlet that is inclined downward. The valve body 203 has a generally cylindrical portion 210 generally symmetrical about an axis and having a front wall 212. The front wall 212 is provided with an outlet orifice 214 which cooperates with a valve member 260 to open and close the dispensing valve as explained more fully below. The valve body 203 is also provided with an actuator 216 which is pressed by the user to open the valve and dispense the contents of the liquid container. The actuator 216 is a generally half-cylindrical structure hinged at its upper end to the valve body 203 by means of a hinge 218. The actuator 216 is connected by actuating rod 264 to the front surface 262 of the valve member 260. In a first, or closed, position the front surface 262 of the valve member 260, which may be a frustoconical surface as shown, occludes the outlet orifice 214 in the front wall 212 of the valve body 203. When the actuator is pressed, the valve member 260 is displaced axially rearward to its second position wherein the front surface 262 of the valve member 260 does not occlude the outlet orifice 214. When the actuator 216 is pressed, the edges of the side walls 220 of the actuator approach closely to the front wall 212 of the cylindrical section 210 of the valve body 203, thereby forming a kind of channel to direct the flow of the liquid downward. Preferably the valve body, actuator and hinge are integrally molded from a suitable synthetic resin.

The cap 230 of the dispensing valve 200 fits onto the rear of the valve body 203 and held thereon by means of a retaining groove 206. The cap is provided with holes 234 through which liquid may flow from the container to which the valve is attached to the valve orifice 214. The cap bears resilient fingers 236 fixed at their bases 238 to the rear wall 232 of the cap 230. The camming action of the tips 240 and camming surfaces 242 of the resilient flexible fingers 236 on the conical camming surface 266 of the valve member 260 to exert a biasing force toward its closed position is essentially the same as in the embodiment illustrated in FIGS. 1–13 and discussed above. Similarly, it is preferred that the embodiment of the invention illustrated in FIGS. 15–18 be molded of a single synthetic resin material, preferably polypropylene.

Although in the illustrated embodiments of the invention the camming surface is located on the valve member and the resilient fingers are fixed within the valve, it will be appreciated by those skilled in the art that the camming surface could be fixed within the valve body and the resilient fingers located on the valve member.

Another embodiment of the invention is illustrated in FIGS. 18–22. In the dispensing valve 300 of this embodiment a valve housing 302 comprises a valve body 303 and a cap 330. The valve body 303 has a generally cylindrical section 312 which is generally symmetrical about an axis 313. The valve body 303 has a front wall 314 having a valve orifice 315. Preferably the valve orifice 315 is located on the axis 313. A valve member 360 is movable along the axis 313 from a first position in which it obstructs and closes the valve orifice 315 and a second position in which it does not obstruct the valve orifice 315 thereby permitting liquid to flow through the valve assembly 300. The valve body 303 is also provided with an actuator 316 which is pressed by the user to open the valve and dispense the contents of the liquid container. The operation of the actuator 316 in the embodiment of FIGS. 18–22 is essentially the same as in the embodiment of FIGS. 14–17. The half-cylindrical actuator 316 is hinged at its upper end to the valve body 303 by means of a hinge 318 and is connected by actuating rod 364 to the front surface 362 of the valve member 360. When the actuator is pressed, the valve member 360 is displaced axially to its second position wherein the front surface 362 of the valve member 360 does not occlude the outlet orifice 315. At the same time the edges of the side walls 320 of the actuator cooperate with the front wall 314 of the valve body 303 to form a channel.

The valve member 360 is provided with a guide rod 368 and a shoulder 366 which provides a bearing surface for the fingers 382 which bias the valve member toward its closed position.

The resilient fingers in this embodiment of the invention are fixed at their bases 384 to a mounting ring 380 which fits within the valve body 303 and is held against a shoulder 313 by the cap 330. The fingers extend radially inward and their tips 386 bear against the rear surface of the shoulder 366 on the valve member 360. The fingers 382 may be oriented perpendicular to the axis 311 or may be oriented at an angle to the axis 311. It is only necessary that the fingers be able to be deflected when the valve member 360 is displaced from its first, closed, position to its second, open, position.

A cap 330 covers the rear opening of the valve body 303 and is held in place by a lip 339 which fits into a groove 306 within the valve body 303. The cap engages the rear surface 381 of the finger mounting ring 380 to hold it against the shoulder 313 in the valve body 303. The cap is provided with holes 334 through which liquid may flow from the container to which the valve is attached to the valve orifice 314. A cylindrical valve member guide 336 is fixed to the rear wall 332 of the cap 330 and extends axially surrounding the guide rod 368 of the valve member 360.

In this embodiment also it is preferred that all the parts be made from a suitable synthetic resin, preferably polypropylene.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

I claim:

1. A self-closing dispensing valve comprising a valve housing having a fluid conduit therethrough, said conduit having a valve orifice, a valve member within said valve body displaceable along an axis from a first position in which said valve member obstructs the flow of fluid through said valve orifice to a second position in which said valve member does not obstruct the flow of fluid through said valve orifice, and biasing means for biasing said valve member toward said first position, said biasing means comprising at least one resilient flexible finger having a base end and a tip end, said base end being fixed to one of said valve housing and said valve member, said tip end being positioned to contact the other of said valve member and said valve housing and be deflected when said valve member is displaced from said first position toward said second position wherein said biasing means additionally comprises a camming surface on one of said valve member and said valve housing, and said at least one resiliently flexible finger extends generally parallel to said axis, said tip end of said resiliently flexible finger being positioned to contact said camming surface and be displaced transversely to said axis when said valve member is displaced from said first position toward said second position.

2. The dispensing valve of claim 1 wherein said camming surface deflects said finger toward said axis when said valve member is displaced from said first position to said second position.

3. The dispensing valve of claim 1 wherein said camming surface is on said valve member and said finger is on said valve housing.

4. The dispensing valve of claim 1 wherein said valve housing comprises a valve body having an outlet section with a generally cylindrical wall symmetrical about said axis and said valve orifice is an aperture in said cylindrical wall of said outlet section.

5. The dispensing valve of claim 4 wherein said camming surface is a conical surface generally symmetrical about said axis.

6. The dispensing valve of claim 5 having at least a pair of said fingers symmetrically positioned with respect to said axis.

7. The dispensing valve of claim 6 wherein said camming surface deflects said fingers toward said axis when said valve member is displaced from said first position to said second position.

8. The dispensing valve of claim 6 comprising more than one pair of said resilient fingers.

9. The dispensing valve of claim 6 comprising three pairs of said resilient fingers.

10. The dispensing valve of claim 6 wherein said camming surface is on said valve member and said fingers are on said valve housing.

11. The dispensing valve of claim 6 wherein said valve member is provided with a surface that obstructs said aperture when said valve member is in said first position and does not obstruct said aperture when said valve member is in said second position.

12. The dispensing valve of claim 6 wherein said valve housing, said valve member and said resilient fingers are molded from a synthetic resin.

13. The dispensing valve of claim 12 wherein said synthetic resin is polypropylene.

14. The dispensing valve of claim 6 wherein said valve housing comprises a valve body and a cap.

15. The dispensing valve of claim 14 wherein said resilient fingers are fixed to said cap.

16. The dispensing valve of claim 15 wherein said resilient fingers are integrally molded with said cap.

17. The dispensing valve of claim 16 wherein said valve body, cap, resilient fingers and valve member are molded from a synthetic resin.

18. The dispensing valve of claim 17 wherein said synthetic resin is polypropylene.

19. The dispensing valve of claim 1 wherein said valve housing has a front wall generally perpendicular to said axis and said orifice is an aperture in said front wall.

20. The dispensing valve of claim 19 wherein said camming surface is on said valve member and said finger is on said valve housing.

21. The dispensing valve of claim 19 wherein said camming surface deflects said finger toward said axis when said valve member is displaced from said first position to said second position.

22. The dispensing valve of claim 19 wherein said camming surface is a conical surface generally symmetrical about said axis.

23. The dispensing valve of claim 22 having at least a pair of said fingers symmetrically positioned with respect to said axis.

24. The dispensing valve of claim 23 comprising three pairs of said resilient fingers.

25. The dispensing valve of claim 23 wherein said camming surface deflects said fingers toward said axis when said valve member is displaced from said first position to said second position.

26. The dispensing valve of claim 23 comprising more than one pair of said resilient fingers.

27. The dispensing valve of claim 23 wherein said camming surface is on said valve member and said fingers are on said valve housing.

28. The dispensing valve of claim 23 wherein said valve member is provided with a surface that obstructs said aperture when said valve member is in said first position and does not obstruct said aperture when said valve member is in said second position.

29. The dispensing valve of claim 23 wherein said valve housing, said valve member and said resilient fingers are molded from a synthetic resin.

30. The dispensing valve of claim 23 wherein said valve housing comprises a valve body and a cap.

31. The dispensing valve of claim 30 wherein said resilient fingers are fixed to said cap.

32. The dispensing valve of claim 31 wherein said resilient fingers are integrally molded with said cap.

33. The dispensing valve of claim 32 wherein said valve body, cap, resilient fingers and valve member are molded from a synthetic resin.

34. The dispensing valve of claim 33 wherein said synthetic resin is polypropylene.

* * * * *